US011619435B1

(12) United States Patent
Cecil

(10) Patent No.: US 11,619,435 B1
(45) Date of Patent: Apr. 4, 2023

(54) APPARATUS FOR MAKING CLEAR ICE

(71) Applicant: DABCO, LLC, Annapolis, MD (US)

(72) Inventor: John David Cecil, Annapolis, MD (US)

(73) Assignee: DABCO, LLC, Annapolis, MD (US)

( * ) Notice: Subject to any disclaimer, the term of this patent is extended or adjusted under 35 U.S.C. 154(b) by 0 days.

(21) Appl. No.: 17/746,091

(22) Filed: May 17, 2022

(51) Int. Cl.
*F25C 1/18* (2006.01)
*F25C 1/22* (2018.01)

(52) U.S. Cl.
CPC ..... *F25C 1/18* (2013.01); *F25C 1/22* (2013.01); *F25C 2400/08* (2013.01)

(58) Field of Classification Search
CPC ..... F25C 1/18; F25C 1/22; F25C 2400/08
See application file for complete search history.

(56) References Cited

U.S. PATENT DOCUMENTS 3,019,617 A * 2/1962 Malthaner ..... F25C 1/24 249/134
5,830,379 A * 11/1998 Tunzi ..... F25C 1/243 249/126
9,272,444 B2 3/2016 Zorovich et al.
9,784,492 B2 10/2017 Little et al.
9,863,683 B2 * 1/2018 Baumbach ..... F25C 1/18
D877,213 S 3/2020 Lord
10,697,684 B2 6/2020 Bertolini et al.
2020/0033042 A1 * 1/2020 Junge ..... F25C 1/22
2020/0072522 A1 * 3/2020 Murphy ..... F25C 1/18

FOREIGN PATENT DOCUMENTS

AU 2020101110 * 6/2020 ..... F25C 1/243

* cited by examiner

*Primary Examiner* — Cassey D Bauer
(74) *Attorney, Agent, or Firm* — Laubscher & Laubscher, PC

(57) ABSTRACT

A method and apparatus for making clear ice utilizes an insulated cooler tray, a container, and degassed water arranged in the container. The container includes a chamber in an upper portion and at least and preferably a plurality of receptacles in a lower portion, with the chamber and receptacles being filled with degassed water. The container is arranged in the cooler tray which includes a greater amount of insulating material in the bottom of the tray than in the top. When the container and cooler tray are arranged in a freezer, the tray causes directional freezing of the degassed water which forces any residual gas or air in the water to the bottom of the container into the receptacles. When directional freezing is complete, the bottom portion of the container may be broken away and the clear ice product removed from the container chamber for use.

12 Claims, 6 Drawing Sheets

Section A-A'

APPARATUS FOR MAKING CLEAR ICE

The present invention generally relates to the process and method to produce clear blocks or chunks of ice for drinks. The resulting clear ice can then be processed via sculpting or an ice press to configure the ice into any desired shape or configuration.

BACKGROUND OF THE INVENTION

Large clear ice cubes are very desirable for use in drinks. The slow melting of these cubes does not dilute the beverage of choice and melts very slowly compared to regularly used smaller ice cubes. Clear ice cubes are the most sought after compared to cloudy ice. Clear ice is very pure and will not alter the taste of the drinks and melts slower.

Obtaining the ultimate objective of freezing water into clear ice has been a difficult task to achieve. Water contains many forms of gases such as carbon dioxide, oxygen, nitrogen, etc. When water freezes, these gases are trapped inside the water and the ice turns cloudy. There are several companies that offer a solution to freezing clear ice, but they are time consuming and difficult to use. They are also not appealing to retail establishments such as bars and restaurants which need numerous ice cubes in a single day. There are many companies that offer a mold that can be used to freeze large ice balls. Some of these molds produce fairly clear ice while others do not. A majority of the molds produce very cloudy ice.

SUMMARY OF THE INVENTION

Accordingly, it is a primary object of the invention to provide an apparatus for making clear ice. The apparatus includes a container preferably formed of a synthetic plastic material which has a tapered side wall and a bottom wall to define a chamber. The bottom wall contains at least one opening below which extend at least one receptacle or tube, respectively. A volume of at least partially degassed water is arranged in the container chamber and within the at least one receptacle. A closure is removably connected with the upper edge of the side wall via an adhesive to close the chamber. When the container is arranged in a freezer or other environment having a temperature below freezing, the degassed water progressively freezes toward the bottom wall to direct residual gas within the water into the at least one receptacle to produce a clear ice product in the chamber and a cloudy ice product in the receptacle.

The container side wall preferably extends beyond the bottom wall to define a lower portion of the container. The container lower portion is preferably rotatable relative to the upper portion of the container. Accordingly, after freezing of the water, the upper and lower portions of the container are rotated relative to one another to sever the cloudy ice in the receptacle from the clear ice product in the container.

Preferably, a plurality of receptacles in the form of tubes are provided. A plurality of radially extending flanges are provided between the tubes and the inner surface of the side wall bottom portion to strengthen the tubes, particularly when the lower container portion is rotated relative to the upper portion.

According to a preferred embodiment, the apparatus also includes a cooler tray which contains a tapered opening in the upper surface configured to receive the container in a snug fit condition. The tray is formed of insulation material which surrounds the opening. More particularly, the insulation material is thicker at the bottom of the tray than at the top. That is, there is more insulation material adjacent the bottom of the tray than at the top, with the thickness of the insulation material increasing progressively toward the bottom owing to the taper of the opening. With such a tray, the insulation material produces directional freezing of the at least partially degassed water from the container chamber toward the tubes when the tray and container are arranged in a freezer.

The tray is designed to be stackable with other trays and also may be provided with multiple openings to receive a plurality of containers. Thus, a plurality of clear ice products can be manufactured simultaneously, one in each container.

In accordance with a method for manufacturing a clear ice product, a quantity of water is at least partially degassed and arranged in a container having a plurality of tubes in the container bottom. The container with the partially degassed water is arranged in an insulated cooler tray which contains an insulation material which progressively increases from an upper portion of the tray to the tray bottom portion. The tray and container are arranged in an environment having a temperature below freezing, such as in a freezer, to directionally freeze the at least partially degassed water to form a clear ice product within the container and to direct residual gas within the water into the tubes to form cloudy ice products within the tubes.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
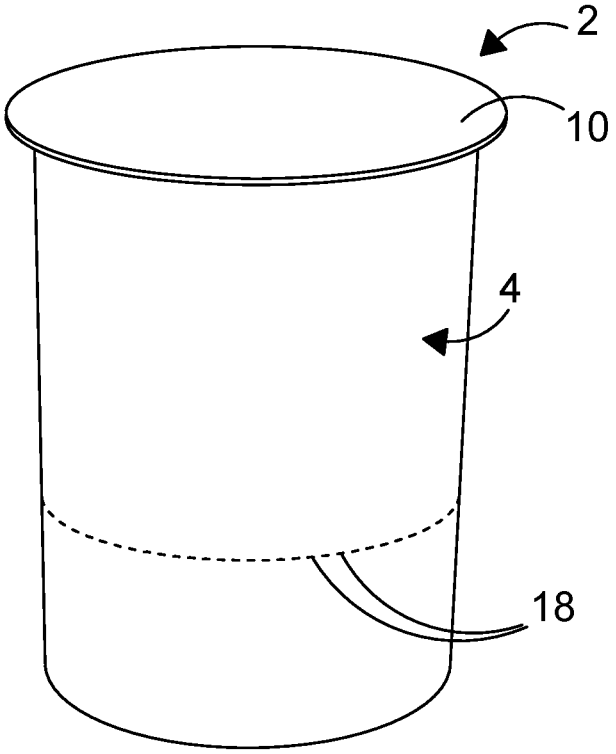
FIG. 1 is a front perspective view of a container for the clear ice manufacturing apparatus according to the invention.

The container 2 for the apparatus for forming clear ice will be described with reference to FIGS. 1-4. The container has a side wall 4 which is preferably tapered so that the container is wider at the top than at the bottom. While the container is shown in the drawing as having a generally cylindrical configuration, it will be appreciated that other geometric shapes may be provided in accordance with the desired configuration of the clear ice product being formed. In a first embodiment, the container includes a bottom wall 6 within and connected with the side wall to define a chamber which is open at its upper end. The upper end of the container side may include an annular lip 8 to which closure 10 is connected. The closure is preferably sealed to the lip by an adhesive so that it may be removed by peeling away from the container as is known in the art. The container and closure are formed of suitable materials known in the container art. By way of example only, the container is formed of a synthetic plastic material and can be formed inexpensively by molding and the closure is a flexible material such as a foil or plastic sealing film or suitable paper product which is easily removed from the container by the user.

Figure 2:
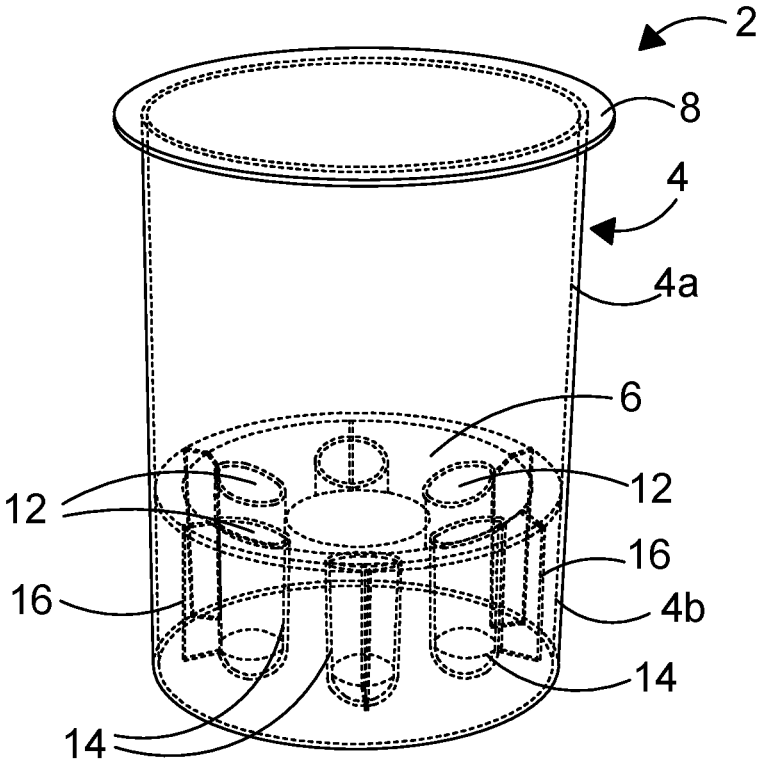
FIG. 2 is a front perspective sectional view of the container of FIG. 1.
Figure 3:
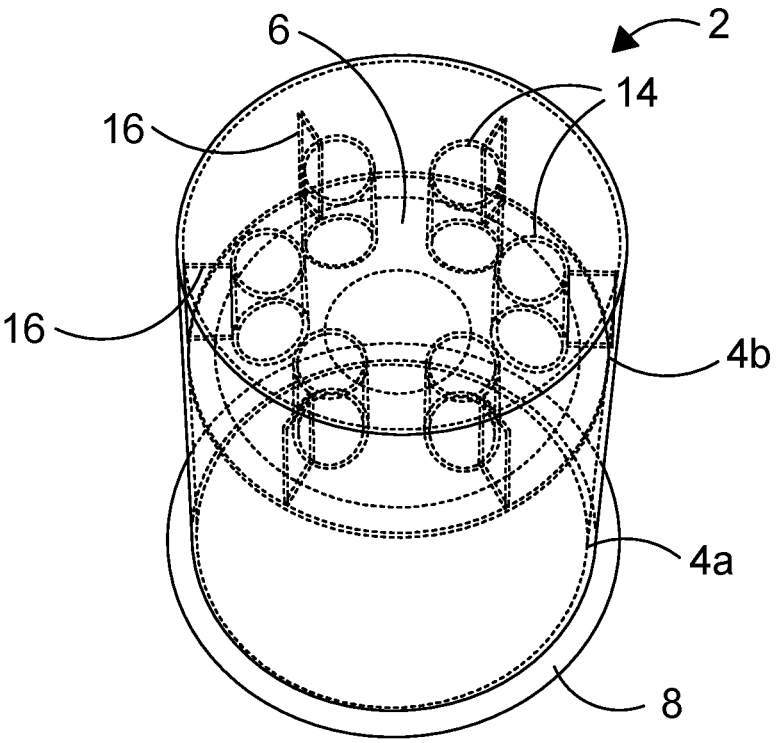
FIG. 3 is a bottom perspective view of the container of FIG. 1.

The bottom wall 6 of the container preferably has a concave configuration as shown for example in FIG. 2. The bottom wall preferably is not at the bottom of the side wall but rather is connected with an inner surface of the side wall at a distance from the lower edge of the side wall. The bottom wall thus defines upper 4*a* and lower 4*b* portions of the side wall as shown in FIGS. 2 and 3. The bottom wall 6 contains at least one and preferably a plurality of openings 12 which are preferably arranged in a circle and equally spaced about the bottom wall 6. In the embodiment shown, six openings are provided, but it will be appreciated that any number of openings may be provided. Extending from each opening is a receptacle 14. The receptacles are preferably the same size and configuration and communicate with the chamber via the openings. The receptacles may have different configurations and are preferably tubular.

The container is filled with water at a production facility and then sealed with the closure 10 for shipping to a customer. It should be noted that the water fills not only the chamber within the container by also the receptacles or tubes depending from the bottom wall 6. A characterizing feature of the water is that it is at least partially degassed prior to insertion into the container. Typically, water such as spring or tap water used for drinking contains a number of gasses such as carbon dioxide, oxygen, nitrogen and the like. Degassing of the water is by any suitable technique such as pouring the water through a fine mesh filter. Although as much gas is removed from the water as possible prior to filling the container, residual gas remains in the water. The residual gas results in a cloudy appearance in the resulting ice formed when the water is frozen.

Figure 4:
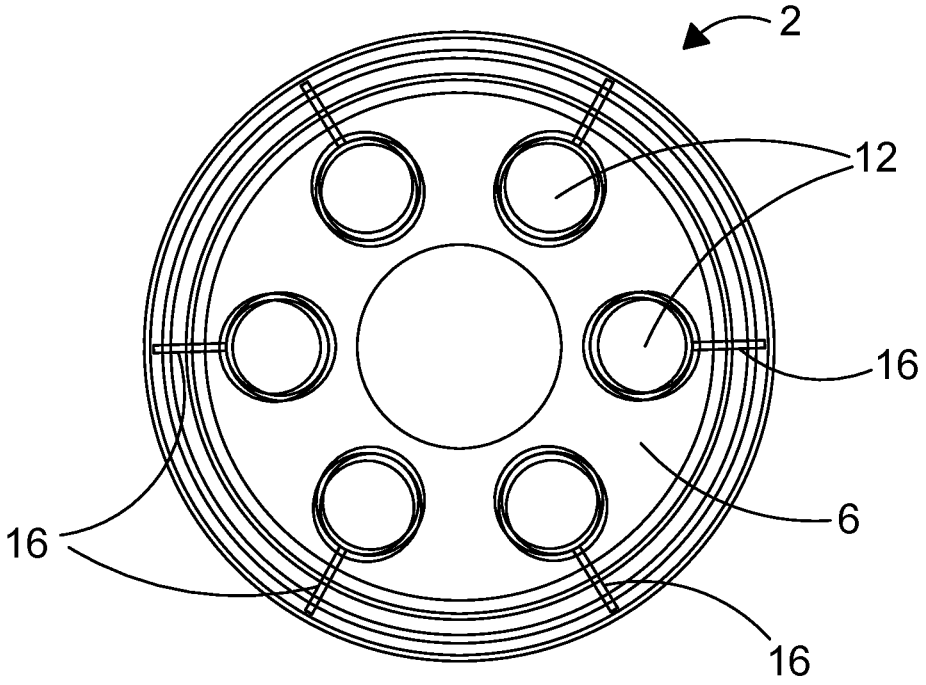
FIG. 4 is a top view of the container of FIG. 2.
Figure 5:
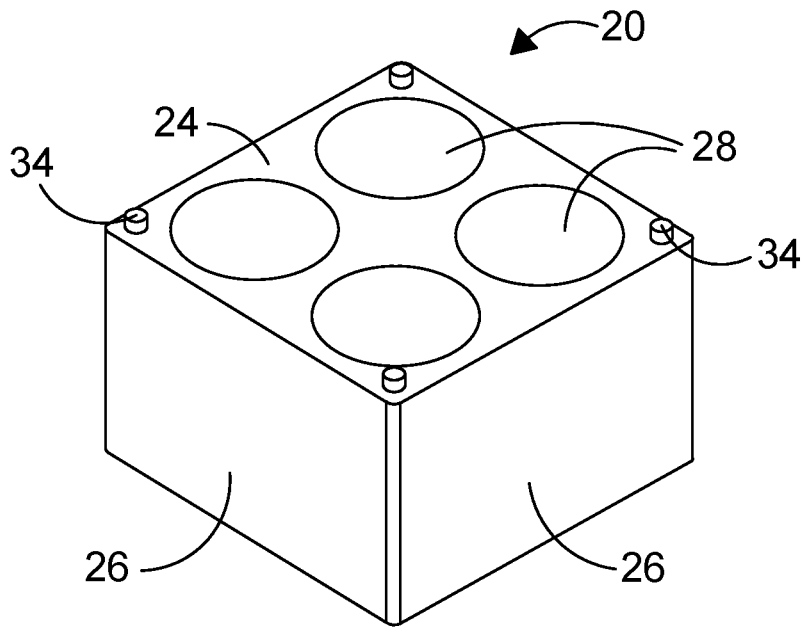
FIG. 5 is a top perspective view of a cooler tray for the clear ice manufacturing apparatus according to the invention.
Figure 6:
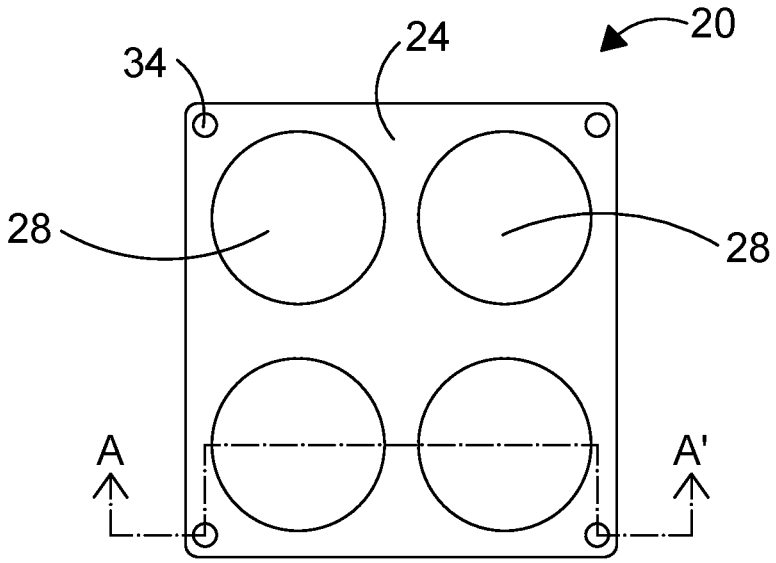
FIG. 6 is a top view of the tray of FIG. 5.

As shown in FIGS. 3 and 4, each tube has a radially extending flange 16 connected between an outer surface of the tube and the inner surface of the side wall lower portion 4*a*. The flanges 16 are preferably integrally molded with the tubes and container side wall and provide stability to the tubes.

The container is designed so that the lower portion thereof may be rotationally displaced relative to the upper portion via a twisting motion. To facilitate this displacement, partial or complete perforations 18 are formed in the outer surface of the container side wall essentially in the same plane where the edge of the first bottom wall connects with the inner surface of the side wall. That is, the perforations are circumferentially arranged in the outer side wall surface of the container in the region which divides the side wall upper portion 4*a* from the side wall lower portion 4*b*.

Referring now to FIGS. 5-9, the cooler tray 20 of the clear ice manufacturing apparatus according to the invention will be described. In the embodiment shown in the drawing the tray has a square configuration including a bottom wall 22, a top wall 24, and side walls 26. Of course, other configurations of the tray are possible. The top wall contains at least one opening or recess 28, four of which are shown in the embodiment. Each opening is configured to match the configuration of the outer surface of the container 2 of FIGS. 1-4. Thus, the openings have a depth which corresponds with the height of the container and a taper which matches the taper of the outer portion of the container. Preferably, each container is arranged in an opening in a snug-fit relation with the outer wall surface of the container in contiguous relation with the inner wall surface of a tray opening as will be developed below. However, the containers are not so tightly arranged within the openings as to not be easily separated from the tray. Ideally, when the tray is turned upside down, the containers will fall from the respective openings.

Figure 7:
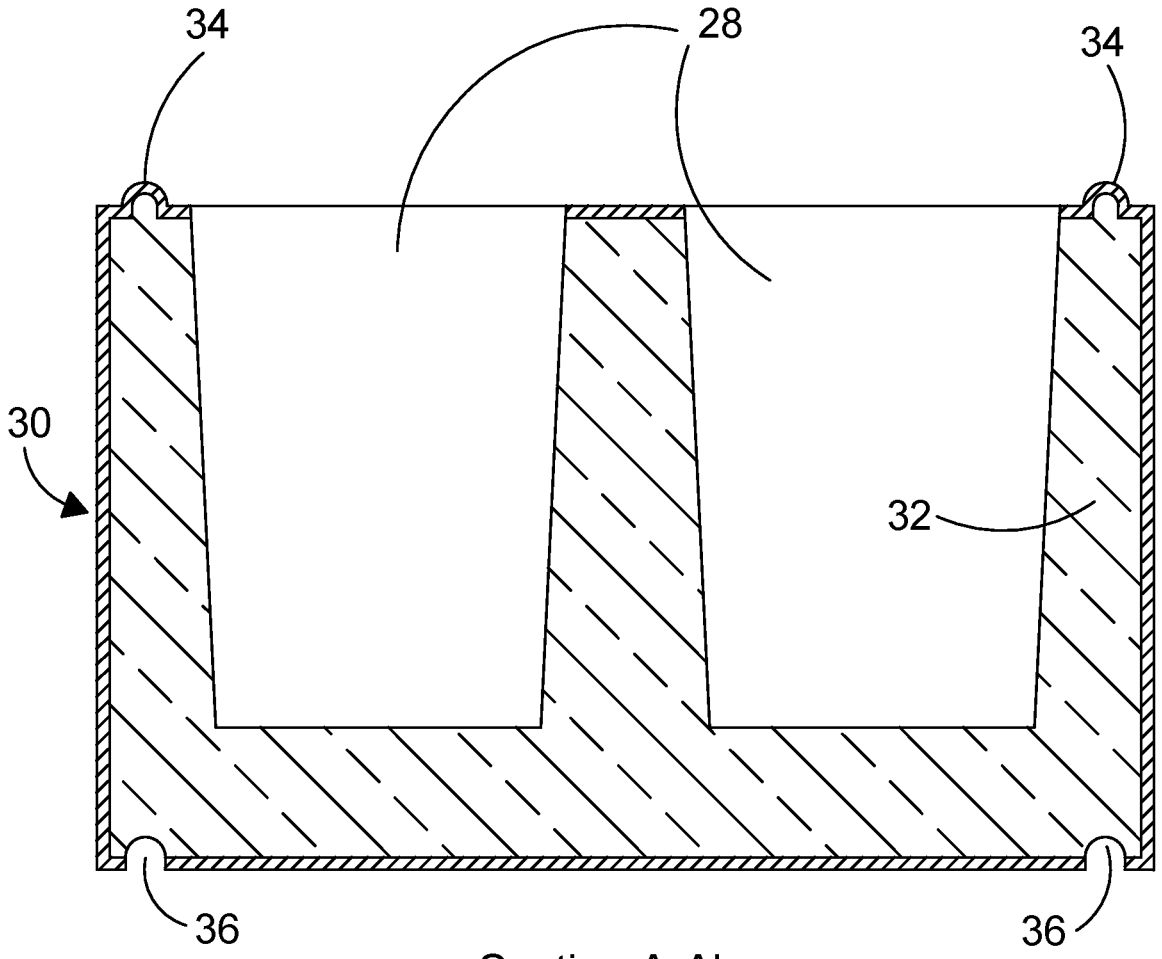
FIG. 7 is a sectional view of the tray taking along line 7-7 of FIG. 6.

A preferred embodiment of the cooler tray is shown in FIG. 7. In this embodiment, the tray includes an outer shell 30 formed of synthetic plastic material which contains an insulation material 32. Any suitable insulation material may be used. An example of such a material is expanded polystyrene (EPS) foam. Where the insulation has a sufficient degree of structural rigidity, an outer shell is not required.

An important feature of the tray is that it is designed with more insulation material in the bottom region of the tray, between the bottom of the openings 28 and the bottom wall 22, with less insulation material being provided beneath the top wall 24. Thus, as shown in FIG. 7, the thickness of the insulation material surrounding the sides of the openings gradually increases in the direction from the top toward the bottom of the tray. This is also due to the tapered configuration of the tray openings 30 with more space being provided for insulation material between the bottom portions of the openings than between the top portions of the openings.

Figure 8:
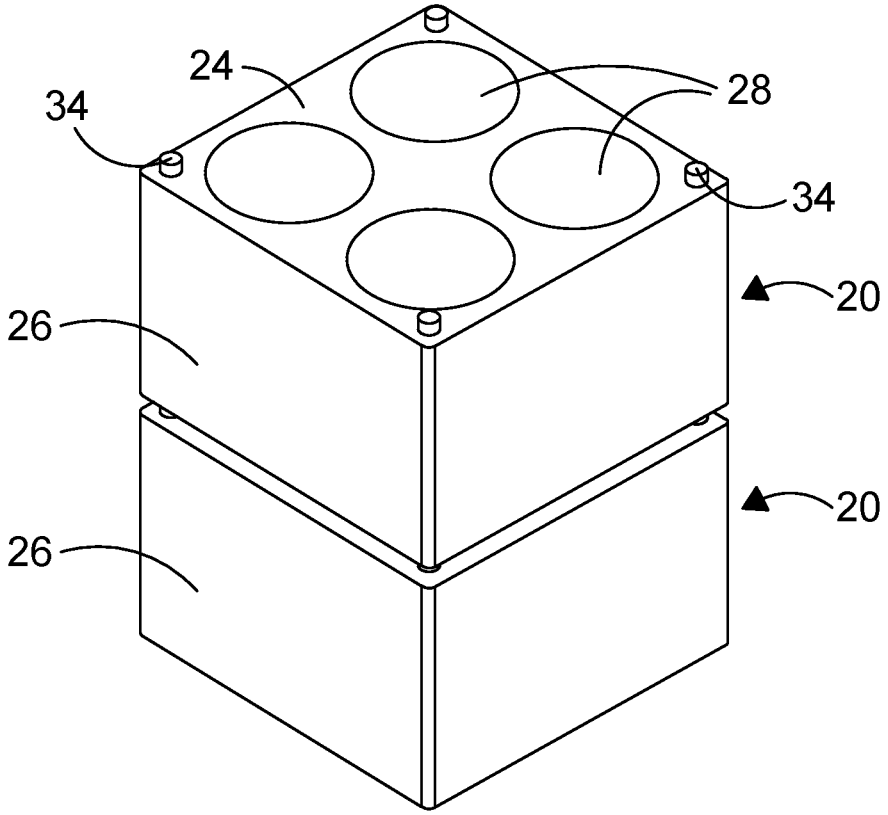
FIGS. 8 and 9 are top perspective and front views, respectively, of a stacked pair of trays.
Figure 9:
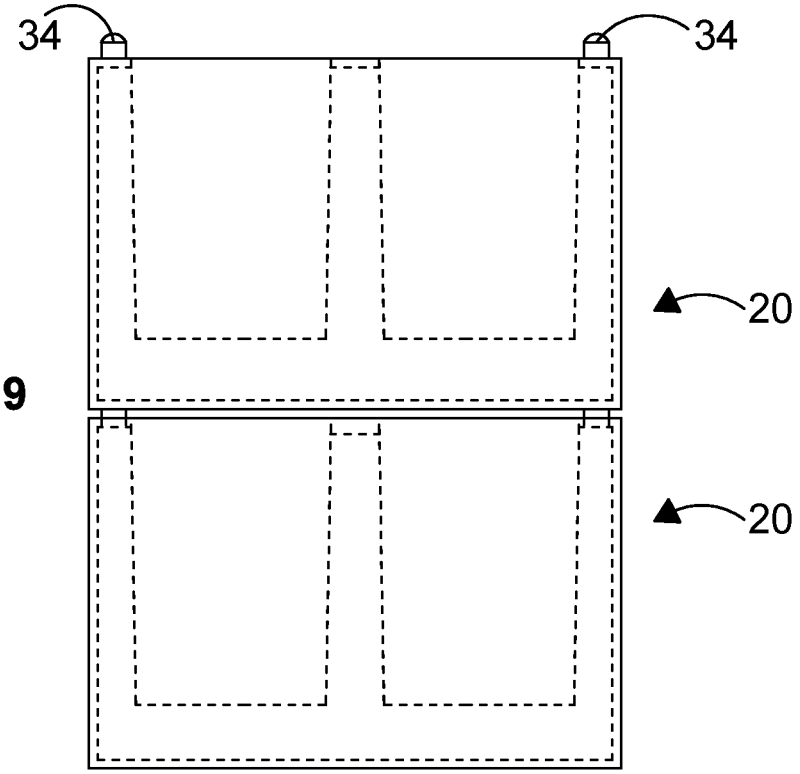

It will also be noted from FIG. 7 that the top wall of the tray includes projections 34 at the corners of the tray and the bottom wall of the tray includes recesses 36 also at the corners of the tray. The configuration of the projections matches the configuration of the recesses so that the trays are stackable as shown in FIGS. 8 and 9 with the projections of a lower tray being arranged in recesses of the adjacent upper tray. Of course, the arrangement and location of the respective projections and recesses is a matter of design choice.

Figure 10:
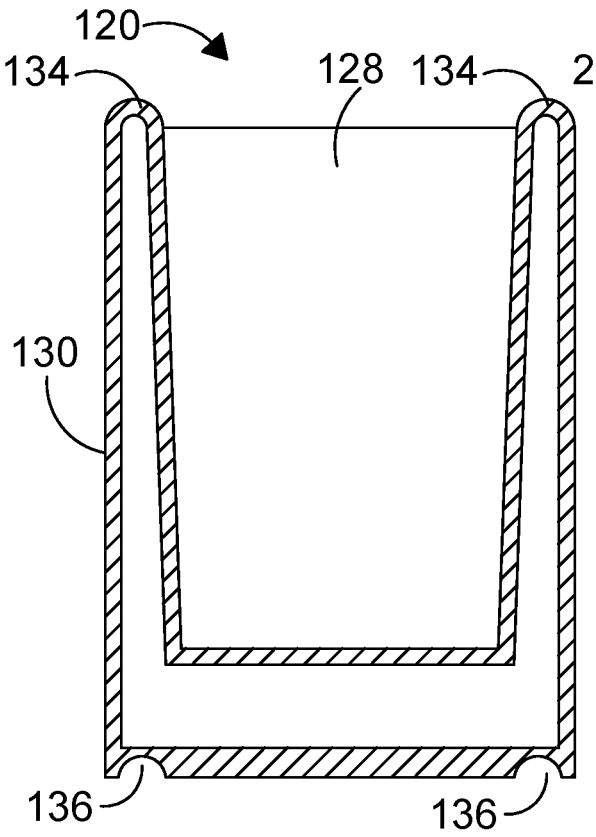
FIGS. 10 and 11 are sectional views of alternate embodiments, respectively, of an insulated cooler tray.
Figure 11:
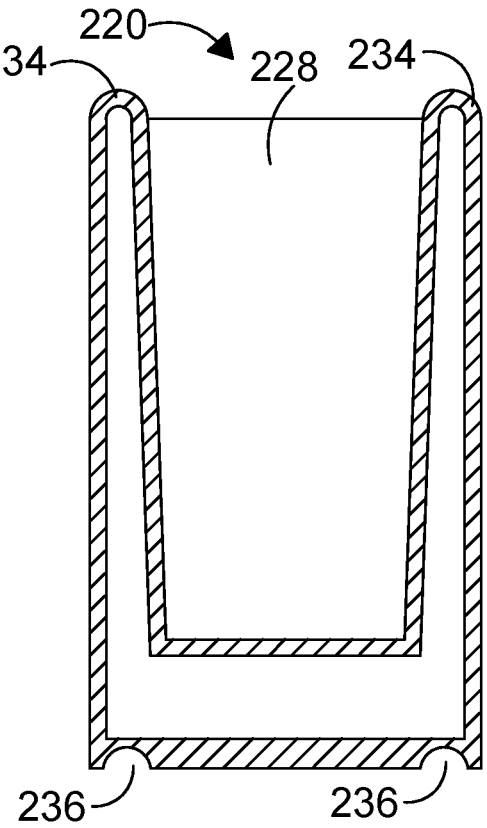
Figure 12:
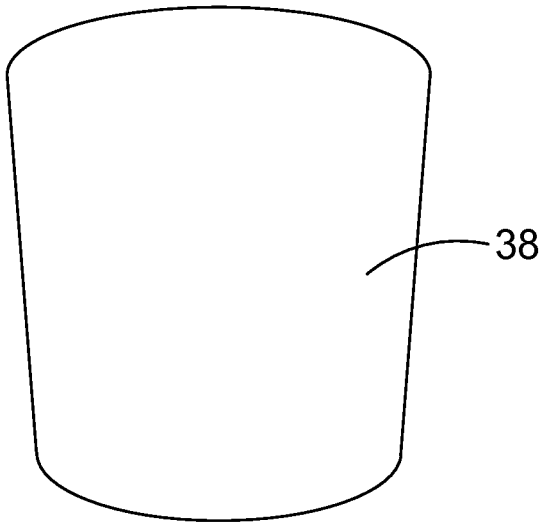
FIG. 12 is a front view of a clear ice product manufactured with the apparatus according to the invention.

Referring now to FIGS. 10 and 11, alternate forms of a cooling tray according to the invention will be described. In these embodiments, the insulation is in the form of a vacuum insulation layer arranged between two structure members. FIG. 10 shows a portion of a cooler tray 120 containing a tapered opening 128. The tray in the form of a shell 130 which contains a outer wall 130*a* and an inner wall 130*b* spaced from the outer wall. Air is evacuated from the space between the inner and outer walls to create a vacuum insulation layer which is known to have excellent insulation properties. As in the embodiment of FIG. 7, the vacuum insulation layer increased from the top of the cooler tray toward the bottom of the cooler tray. The tray includes projections 134 extending from the top wall and corresponding recesses 136 in the bottom wall for stackability. FIG. 11 is similar to the embodiment of FIG. 10 except that the shell 230 has inner and outer walls 230*a* and 230*b* formed of glass instead of stainless steel. The tray contains at least one opening 228, projections 234 in the top wall and corresponding recesses 236 in the bottom wall.

The operation of the apparatus and the method for forming clear ice will now be described. Partially degassed water is arranged in a container which is sealed with a closure. The water fills the tubes 14 of the container and preferably fills the chamber in the upper portion of the container, although a small amount of space may be provided within the chamber to allow for expansion of the water during the freezing process. The filled containers are shipped to a customer who arranges the containers in a tray. As explained above, multiple containers and trays may be provided.

The tray or trays with containers arranged therein are placed in an environment with a temperature below the freezing temperature of the water. Typically, this environment will be within a freezer. Owing to the configuration of the container, the tray openings, and the insulation material within the tray, the partially degassed water within the tubes undergoes directional freezing. That is, the water freezes from the top area of the container and tray where there is less insulation material downwardly into the tubes in the lower portion of the container where there is greater insulation material in the corresponding portion of the tray. The directional freezing forces most if not all of the residual gas in the water from the upper portion of the container into the tubes. By way of example, complete freezing of the water in the container may take between 8 and 24 hours depending on the temperature of the freezer which is the time during which the tray and containers are retained in the freezer.

Once the directional freezing process is complete, the trays are removed from the freezer and the containers are removed from the tray. The closures are also removed from the top of each container. Each container is then gripped by the user, or by an appliance, and the upper and lower portions of the container are rotated slightly relative to each other to at least partially sever the perforations. The twisting of each container breaks off fingers of ice in the tubes of each container from a clear ice product formed in the upper portion of the container. The clear ice product is then removed from the container. If necessary, the clear ice product can be manually popped out of the top of the container and/or water may be run over the outer surface of the container to assist in separating the clear ice product from the inner surface of the container.

Each container thus produces a single ice product 38 which is shown in FIG. 10. The container may be discarded and the ice product saved for future use or further processing such as by an ice press or by a sculptor to produce an ice product of a desired appearance and configuration.

The ice product with gasses removed is clear which is particularly desirable in that it melts slower than cloudy ice and has a clean appearance which may be enhanced with further processing. It is particularly suitable for bars and restaurants to enhance signature cocktails and other beverages. The fingers of ice which are formed in the tubes contain much of the residual gas from the original degassed water in the container. These ice fingers are much cloudier than the clear ice product formed in the upper portion of the container owing to the directional freezing of the ice which essentially diffuses the gas from the upper portion of the container into the tubes. These cloudy fingers of ice are normally discarded as well.

The container is designed as a single serve cup to control the freezing process of the water and the gases/air in the water. As the water freezes in the cup, the freezing water pushes down the gases into the tubes at the bottom of the cup. The result is a clear ice product having a configuration generally dictated by the configuration of the container. After the freezing process is over, the bottom portion of the cup is removed and the large clear ice product is removed from the cup.

While the preferred forms and embodiments of the invention have been illustrated and described, it will become apparent to those of ordinary skill in the art that various changes and modifications may be made without deviating from the inventive concepts set forth above.

What is claimed is:

1. Apparatus for making clear ice, comprising (a) a container having a first bottom wall and a tapered side wall connected with said first bottom wall to define a chamber, said first bottom wall containing at least one opening and said side wall extending beyond said first bottom wall to define a lower portion of said side wall and of said container which is partially rotatable relative to an upper portion of said container;

(b) at least one receptacle extending downwardly from said first bottom wall and aligned with said at least one opening, respectively;

(c) a volume of water arranged in said container chamber and extending into said at least one receptacle; and (d) a closure removably connected with an upper edge of said container side wall to close said chamber, whereby, when said container is arranged in an environment at a temperature below freezing, said water progressively freezes in a direction toward said container first bottom wall to direct gas within said water into said at least one receptacle, thereby to produce a clear ice product in said chamber and cloudy ice in said at least one receptacle and, upon relative rotation of said container upper and lower portions, the cloudy ice formed in said at least one receptacle is severed from the clear ice product formed in said chamber.

2. The apparatus as defined in claim 1, wherein said first bottom wall contains a plurality of openings which are radially arranged and equally spaced within said first bottom wall and each of the plurality of openings includes a receptacle extending downwardly therefrom.

3. The apparatus as defined in claim 1, wherein an outer surface of said container side walls contains a plurality of spaced at least partial perforations which are arranged coplanar with an outer edge of said first bottom wall.

4. The apparatus as defined in claim 2, and wherein said container further comprises a plurality of radially extending flanges between said plurality of receptacles and an inner surface of said side wall lower portion.

5. The apparatus as defined in claim 4, wherein said first bottom wall has a concave configuration.

6. The apparatus as defined in claim 2, wherein said plurality of receptacles comprise tubes.

7. The apparatus as defined in claim 5, wherein said container is formed of synthetic plastic material and said closure is formed of one of a foil and synthetic plastic sealing film which is adhesively connected with said container.

8. The apparatus as defined in claim 1, and further comprising a tray containing at least one tapered opening in an upper surface thereof configured to receive said container in a snug fit condition, said tray comprising an insulation material which surrounds said tapered opening, a thickness of said insulation material progressively increasing from an upper portion of said tray to a bottom portion of said tray, whereby when said tray and container are arranged in said below freezing environment, said insulation material in said tray produces directional freezing of said water.

9. The apparatus as defined in claim 8, wherein said tray contains a plurality of tapered openings to receive a plurality of the containers, respectively, whereby a plurality of clear ice products can be frozen simultaneously.

10. The apparatus as defined in claim 9, wherein an upper surface of said tray includes a plurality of spaced projections and a lower surface of said tray contains a plurality of spaced recesses configured to receive said plurality of projections, respectively, of an adjoining tray, whereby a plurality of trays may be arranged in stacked relation.

11. The apparatus as defined in claim 8, wherein said tray is formed of expanded polystyrene foam.

12. The apparatus as defined in claim 8, wherein said tray is formed of one of a metal and glass including inner and outer walls defining a vacuum insulation layer surrounding said tapered opening.

* * * * *